US010900231B2

(12) United States Patent
Loss et al.

(10) Patent No.: US 10,900,231 B2
(45) Date of Patent: Jan. 26, 2021

(54) FLAT BUILDING ELEMENT

(71) Applicant: ADIGE S.P.A., Levico Terme (IT)

(72) Inventors: Cristiano Loss, Imer (IT); Sergio Raso, Turin (IT)

(73) Assignee: ADIGE S.P.A., Levico Terme (IT)

( * ) Notice: Subject to any disclaimer, the term of this patent is extended or adjusted under 35 U.S.C. 154(b) by 0 days.

(21) Appl. No.: 16/613,242

(22) PCT Filed: May 31, 2018

(86) PCT No.: PCT/IB2018/053868
§ 371 (c)(1),
(2) Date: Nov. 13, 2019

(87) PCT Pub. No.: WO2018/220564
PCT Pub. Date: Dec. 6, 2018

(65) Prior Publication Data

US 2020/0080310 A1 Mar. 12, 2020

(30) Foreign Application Priority Data

Jun. 1, 2017 (IT) ..... 102017000060534

(51) Int. Cl.
*E04C 2/38* (2006.01)
*E04C 2/26* (2006.01)
*E04F 13/10* (2006.01)

(52) U.S. Cl.
CPC ..... *E04C 2/384* (2013.01); *E04C 2/26* (2013.01); *E04F 13/10* (2013.01)

(58) Field of Classification Search
CPC ..... E04C 2/26; E04C 2/384; E04F 13/10
See application file for complete search history.

(56) References Cited

U.S. PATENT DOCUMENTS 1,858,701 A * 7/1929 Boettcher ..... E04B 1/74 52/284
2,047,386 A * 7/1936 Schreiber ..... E04B 1/80 52/404.2

(Continued)

FOREIGN PATENT DOCUMENTS

DE 1559528 A1 3/1970
GB 2019469 A 10/1979

(Continued)

OTHER PUBLICATIONS

JPH09177172 Machine Translation (Year: 2020).*

(Continued)

*Primary Examiner* — James M Ference
(74) *Attorney, Agent, or Firm* — Cantor Colburn LLP

(57) ABSTRACT

A building element is provided which comprises a panel of non-metallic material having a pair of flat and parallel faces, namely a top face and a bottom face, and a plurality of lateral faces extending between the flat and parallel faces, at least one beam of metallic material, having a pair of opposed faces, namely a proximal face and a distal face, and a plurality of connection elements of metallic material that rigidly connect the at least one beam to the panel. Each beam is arranged along a respective lateral face of the panel with the proximal face in contact with the lateral face. Each connection element is a plate element comprising a first portion, which is inserted into a respective seat provided on a respective lateral face of the panel and is fixed therein by an adhesive, and a second portion which protrudes from said respective lateral face.

12 Claims, 5 Drawing Sheets

(56) References Cited

U.S. PATENT DOCUMENTS

| | | | | |
|---|---|---|---|---|
| 2,791,003 | A * | 2/1952 | Berger | E04B 1/10 52/97 |
| 5,720,571 | A * | 2/1998 | Frobosilo | E04B 2/96 403/2 |
| 5,846,018 | A * | 12/1998 | Frobosilo | E04B 2/96 403/403 |
| 5,906,080 | A * | 5/1999 | diGirolamo | E04B 2/7453 411/546 |
| 6,418,694 | B1 * | 7/2002 | Daudet | E04B 5/10 52/262 |
| 6,460,301 | B1 * | 10/2002 | McKee | E04C 2/06 52/235 |
| 7,104,024 | B1 * | 9/2006 | diGirolamo | E04B 2/767 403/231 |
| 7,478,508 | B2 * | 1/2009 | Peterson | E04B 2/96 248/300 |
| 7,503,150 | B1 * | 3/2009 | diGirolamo | E04B 2/96 403/403 |
| 2003/0093969 | A1 * | 5/2003 | Saldana | E04B 1/2403 52/715 |
| 2003/0183742 | A1 * | 10/2003 | DeLoach, Sr. | E04C 5/04 249/18 |
| 2006/0191232 | A1 * | 8/2006 | Salazar et al. | E04C 2/38 52/606 |
| 2010/0031599 | A1 * | 2/2010 | Kennedy et al. | E04B 5/02 52/583.1 |
| 2011/0154768 | A1 * | 6/2011 | Kralic et al. | E04C 2/28 52/578 |
| 2014/0069032 | A1 * | 3/2014 | Philibert et al. | E04B 1/34321 52/79.9 |
| 2015/0184371 | A1 * | 7/2015 | Stauffer | E04C 5/0645 52/701 |
| 2020/0080310 | A1 * | 3/2020 | Loss | E04C 2/26 |

FOREIGN PATENT DOCUMENTS

| | | | |
|---|---|---|---|
| GB | 2395731 | A | 6/2004 |
| JP | H09177172 | A | 7/1997 |
| WO | 2017015680 | A1 | 2/2017 |

OTHER PUBLICATIONS

International Search Report, issued in PCT/IB2018/053868, dated Aug. 7, 2018, Rijswijk, Netherlands.

Written Opinion, issued in PCT/IB2018/053868, dated Aug. 7, 2018, Rijswijk, Netherlands.

* cited by examiner

FLAT BUILDING ELEMENT

CROSS-REFERENCE TO RELATED APPLICATIONS

This application is a U.S. National Phase filing of PCT International Patent Application No. PCT/IB2018/053868, having an international filing date of May 31, 2018, which claims priority to Italian Patent Application No. 102017000060534, filed Jun. 1, 2017 each of which is hereby incorporated by reference in its entirety.

FIELD OF THE INVENTION

The present disclosure generally belongs to the field of civil and/or industrial construction, preferably commercial and residential construction, and relates in particular to a modular building system comprising a plurality of flat building elements, each comprising at least one panel of non-metallic material, preferably wooden material, and at least one beam of metallic material, preferably steel, rigidly connected to the panel via mechanic and/or adhesive joints. Such building elements may be used both with a structural function to make walls, roofs, slabs and coverings, and with a non-structural function, for example to cover substantially flat structures.

BACKGROUND OF THE INVENTION

It is known to use flat building elements made of a panel of non-metallic material, in particular wood, and of beams of metallic material, in particular steel.

The assembly of such elements is not, however, particularly quick nor easy. Further difficulties when using such building elements arise from the necessity of having further components at the assembly site apart from the building element, so that, in addition to screws, nuts and conventional mechanical fasteners for constructions, it may be necessary to use also mortar, glue and/or other connection elements.

Further problems connected to the use of such building elements may be due, for example, to the transport of the elements from the production site to the assembly site and are strongly dependent on the shape of the building element and the arrangement of its components, which define the overall thickness of the element.

Furthermore, the modular construction of walls and slabs by prefabricated building elements made of panels and beams requires the designer to reconsider the positioning of accessory service systems of the building, such as hydraulic and electric systems and telecommunication infrastructures, which can no more be accommodated inside ducts in the walls, but necessarily require a new accommodation.

Thus, there is a need to develop modular building systems using prefabricated dry-mountable building elements that ensure highly comfortable handling and very easy transport, and that, at the same time, are able to meet both the requirements of structural strength and continuity as well as the requirements of insulation, partitioning and use of the architectonical space.

An example of flat building element is known from document DE 1 559 528 A1. According to this known solution, the flat building element comprises a wooden panel, a metal beam and an axial hollow pin connecting the beam with the panel. Such a known solution does not allow an easy connection between adjacent flat building elements.

U.S. Pat. No. 6,460,301 B1 discloses a panel to which metal beams are connected by a layer of bonding concrete.

The beams are arranged on one of the two faces of the panel, which increases the overall thickness of the building element.

GB 2 395 731 A discloses a flat building element comprising a panel and metal beams that are arranged on one of the two faces of the panel and are connected to the panel by screws. Also this known solution leads therefore to a significant overall thickness of the building element.

WO 2017/015680 A1 discloses a flat building element comprising a panel and metal beams connected to the panel by screws. Also in this case, the beams are arranged on one of the two faces of the panel, thus involving a considerable overall thickness of the building element.

U.S. Pat. No. 2,047,386 A discloses an insulating flat element comprising a pair of panels that are arranged parallel to one another and are connected to one another through a series of beams having protrusions which are directed towards the inner side of the element and are adapted to bear an insulating filling material. Such an element is not suitable for structural functions and, in addition, is not connectable to adjacent elements in order to make a horizontal building structure.

GB 2 019 469 A discloses a flat building element comprising a panel and a plurality of beams. To each beam there are associated metal tabs that, immersed in the wet concrete of the panel, ensure connection of the beam with the panel. The beams are arranged on one of the two faces of the panel, which results in a considerable overall thickness of the building element.

SUMMARY OF THE INVENTION

It is an object of the present disclosure to provide a flat building element that can be efficiently used in the construction industry, preferably to make slabs, walls, roofs and/or coverings of buildings, that has a reduced thickness, that is easy to assemble with other similar building elements and that allows to make building structures with high seismic-resistance performances.

This and other objects are fully achieved according to the present disclosure by a flat building element having the features described and claimed herein.

In short, the present disclosure is based on the idea of making a flat building element comprising:

- a panel of non-metallic material, preferably wooden material, such as for example XLAM (Cross-Lam), having a pair of flat and parallel faces, that is, a top face and a bottom face, respectively, and a plurality of lateral faces extending between said flat and parallel faces, preferably perpendicular to the latter;
- at least one metal beam, preferably of steel, having a pair of opposed faces, that is, a proximal face and a distal face, respectively, the beam being rigidly connected to the panel along a lateral face of the panel, in such a way that said proximal face of the beam is in contact with said lateral face of the panel; and
- a plurality of metal connection elements, each made as a plate element comprising a first plate portion which is inserted into a respective seat provided on said lateral face of the panel and is fixed therein by an adhesive, and a second plate portion which protrudes from said lateral face of the panel.

By virtue of the arrangement of the beam(s) with respect to the panel, a flat building element according to the present disclosure provides several advantages over the prior art described above. First, the overall thickness of the element is considerably reduced with respect to the prior art, which increases the easiness of transport and comfort of use. Furthermore, the shape of the beams and their arrangement with respect to the panel allows the building elements to be mounted beside one another and to be fixed to one another with the distal faces of the respective beams in contact with one another.

The cooperation that takes place between panel and beams provides the building element with mechanical resistance and strength properties that are above the sum of the properties of the single components of the building element. The building elements may be rigidly connected to one another or to the main load-bearing structure of the building, through suitable connections configured to provide the horizontal building structures with a plate behaviour, and, anyway, in such a manner as to establish a continuity in the transmission of the stresses along the two principal directions of the building.

Preferably, the panel is of rectangular shape and the flat building element comprises two beams fixed along the two longer sides of the panel.

Preferably, the beams have a hollow cross-section, for example of rectangular shape. The cavity of each beam may advantageously be used to accommodate auxiliary components for the building, such as, for example, components of hydraulic, electric and/or telecommunication networks.

Preferably, the metal connection elements have a cross-section extending along at least two non-parallel directions, such as an L-shaped cross-section.

Further features and advantages of the present disclosure will become apparent from the following detailed description, given purely by way of non-limiting examples, with reference to the attached drawings.

DETAILED DESCRIPTION

Figure 1:
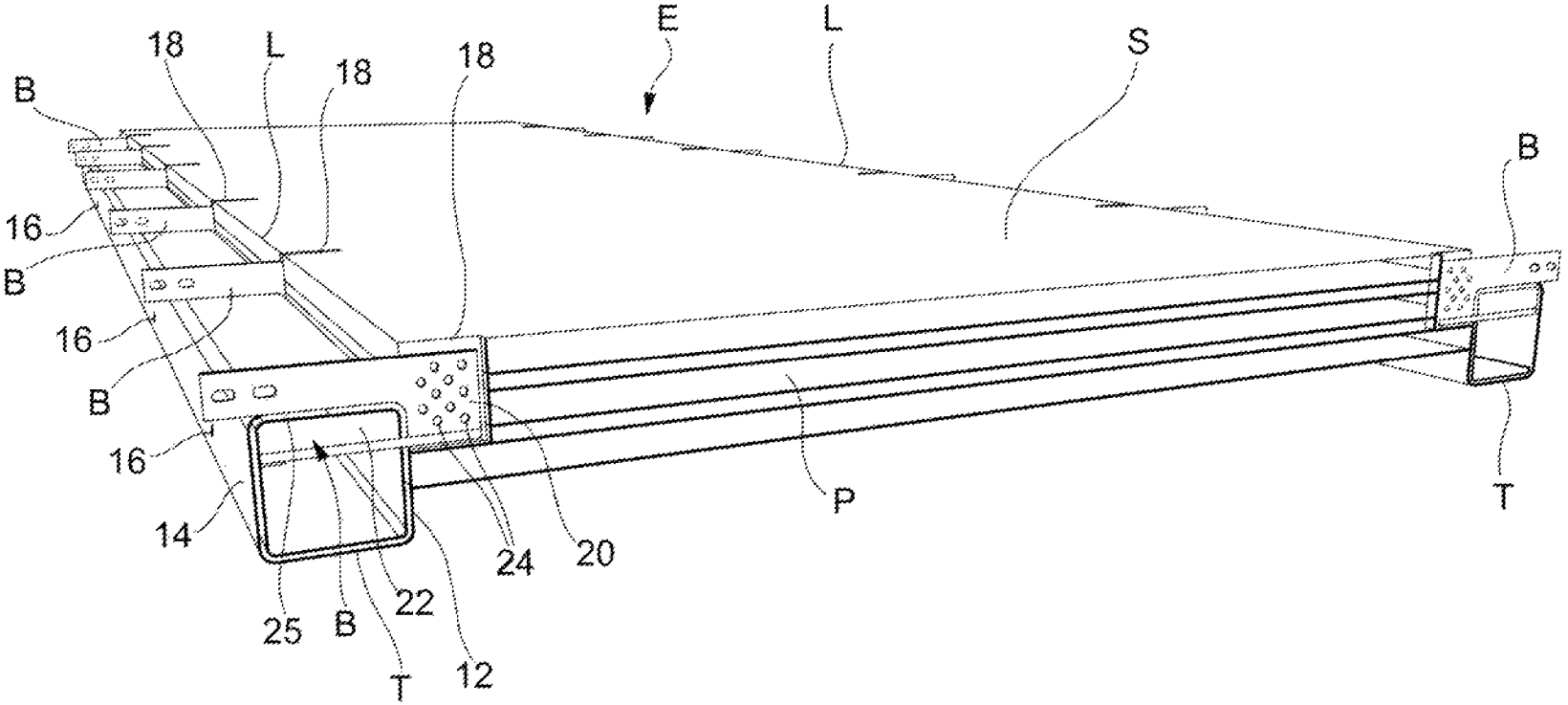
FIG. 1 is a perspective view of a flat building element according to an embodiment of the present disclosure.
Figure 2:
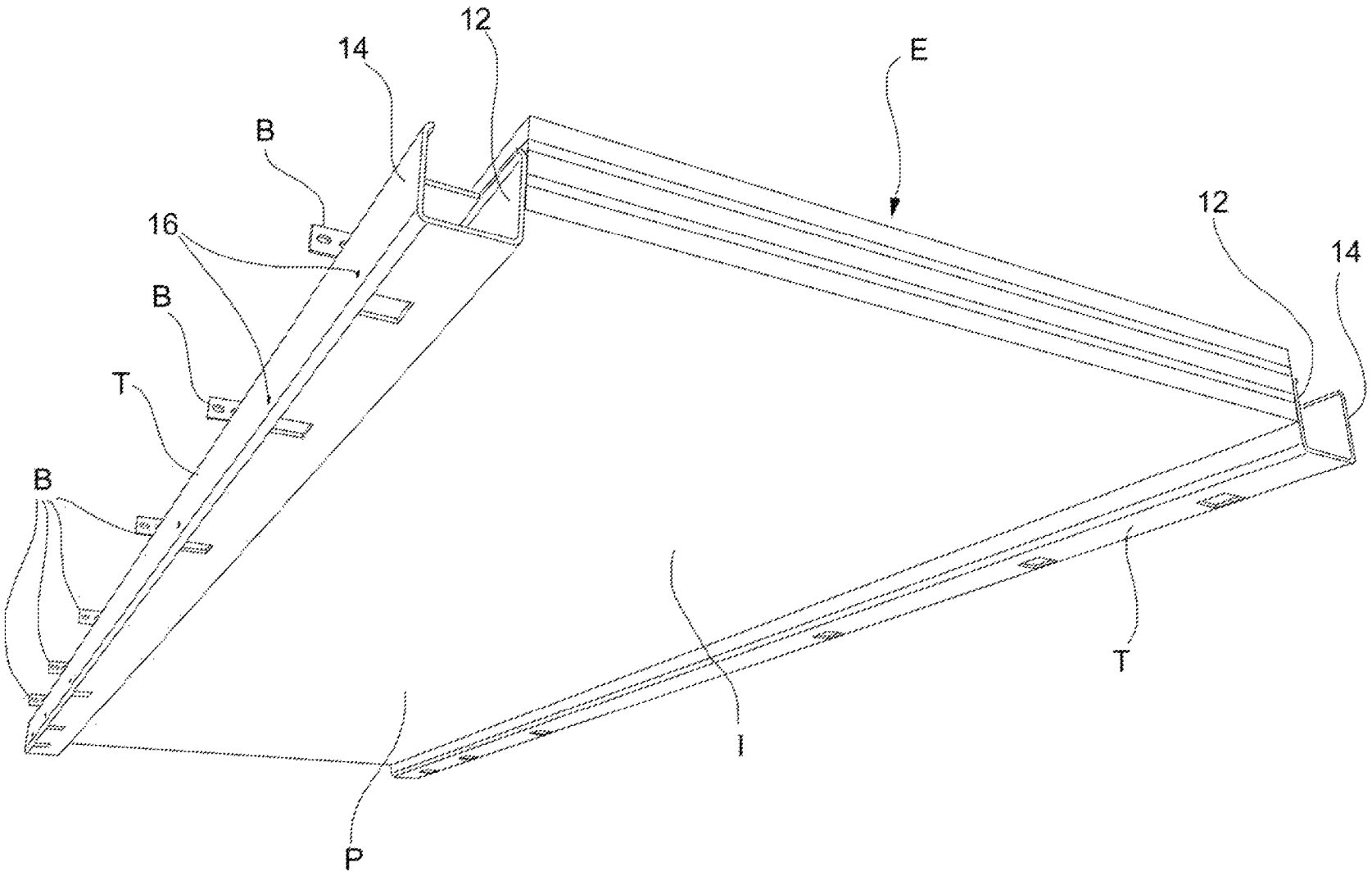
FIG. 2 is a further perspective view of the building element of FIG. 1.

With reference first to FIGS. 1 and 2, a flat building element according to the present disclosure is generally indicated E.

Figure 5:
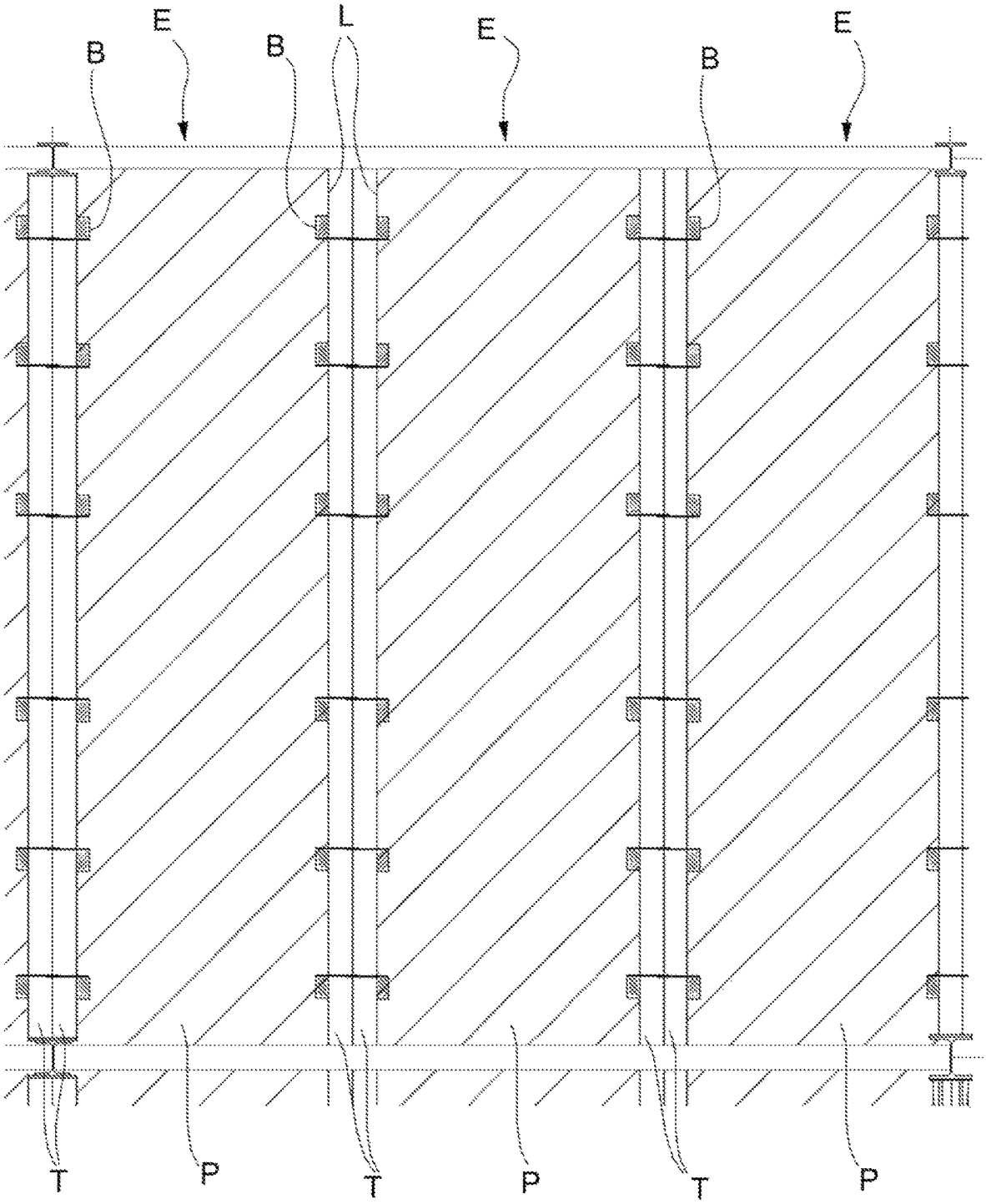
FIG. 5 is a plan view of a portion of a building system made as a slab and obtained by connection of building elements according to the present disclosure.

The building element E defines the basic module of a modular building system with which it is, for example, possible to make horizontal building structures (see FIG. 5).

The building element E basically comprises:

- a panel P of non-metallic material, preferably wood or other similar material,
- at least one beam T (two beams, in the embodiment shown herein) of metallic material, preferably steel, and
- a plurality of connection elements B, made as plate elements, through which each beam T is rigidly connected to the panel P.

As shown in FIGS. 1 and 2, the panel P has a pair of flat and parallel faces, namely a top face S and a bottom face I, and a plurality of sides or lateral faces L, that extend between the top face S and the bottom face I, preferably perpendicular thereto.

Each beam T is arranged along a respective lateral face L of the panel P. In addition, each beam T is arranged in such a way that the respective longitudinal axis is directed parallel to the top face S (or to the bottom face I) of the panel P.

The beams T are preferably elements with a hollow cross-section, for example with a cross-section of rectangular shape, and have a pair of opposed faces 12 and 14, namely a proximal face 12 (that is, a face facing towards the panel P) and a distal face 14 (that is, a face facing towards the opposite side with respect to the panel P). The distal face 14 has connection holes 16, through which suitable threaded fasteners (not shown) can be inserted to provide a mechanic connection between two beams T of two adjacent building elements E.

Figure 3:
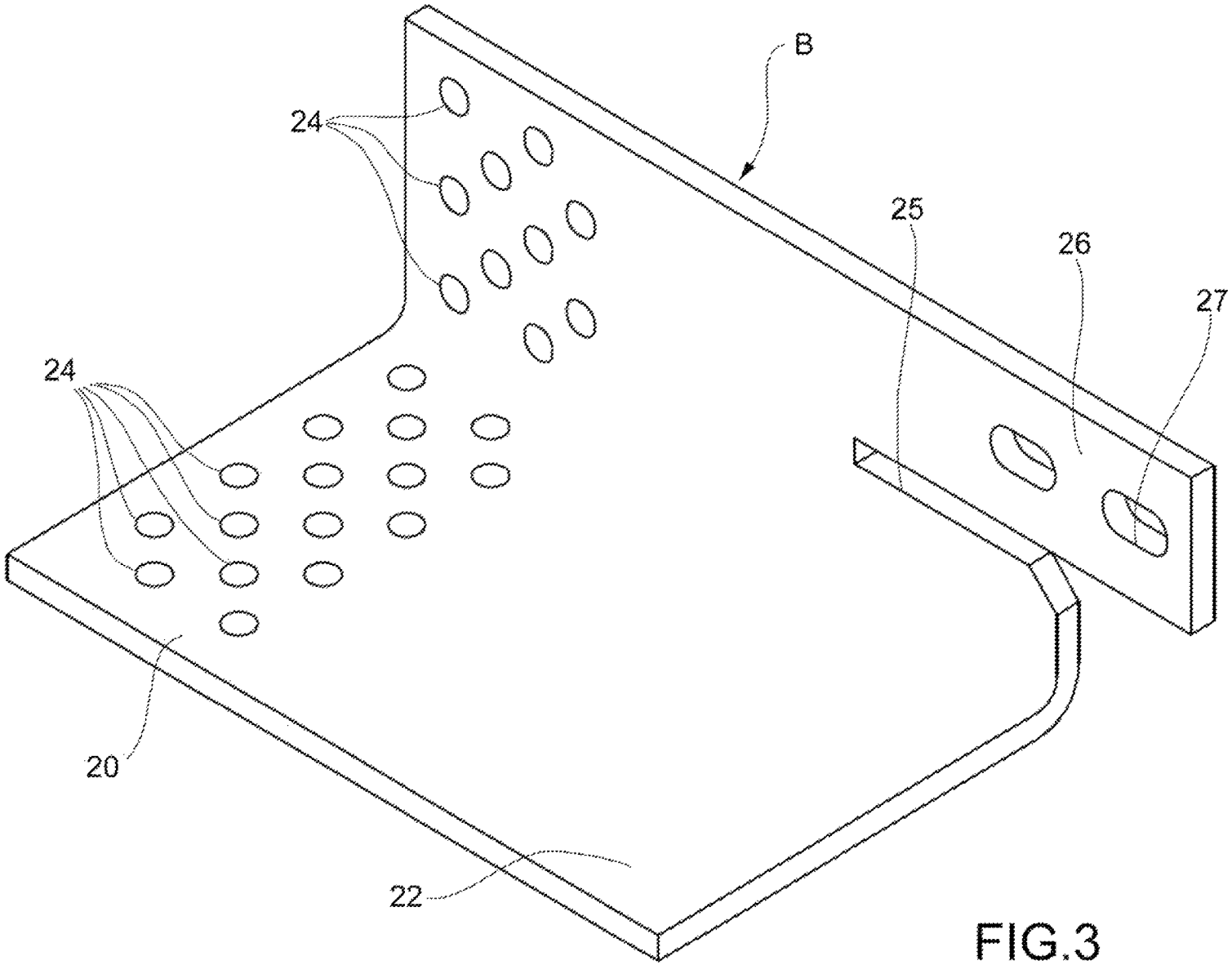
FIG. 3 is an axonometric view of a connection element of the building element of FIG. 1.
Figure 4:
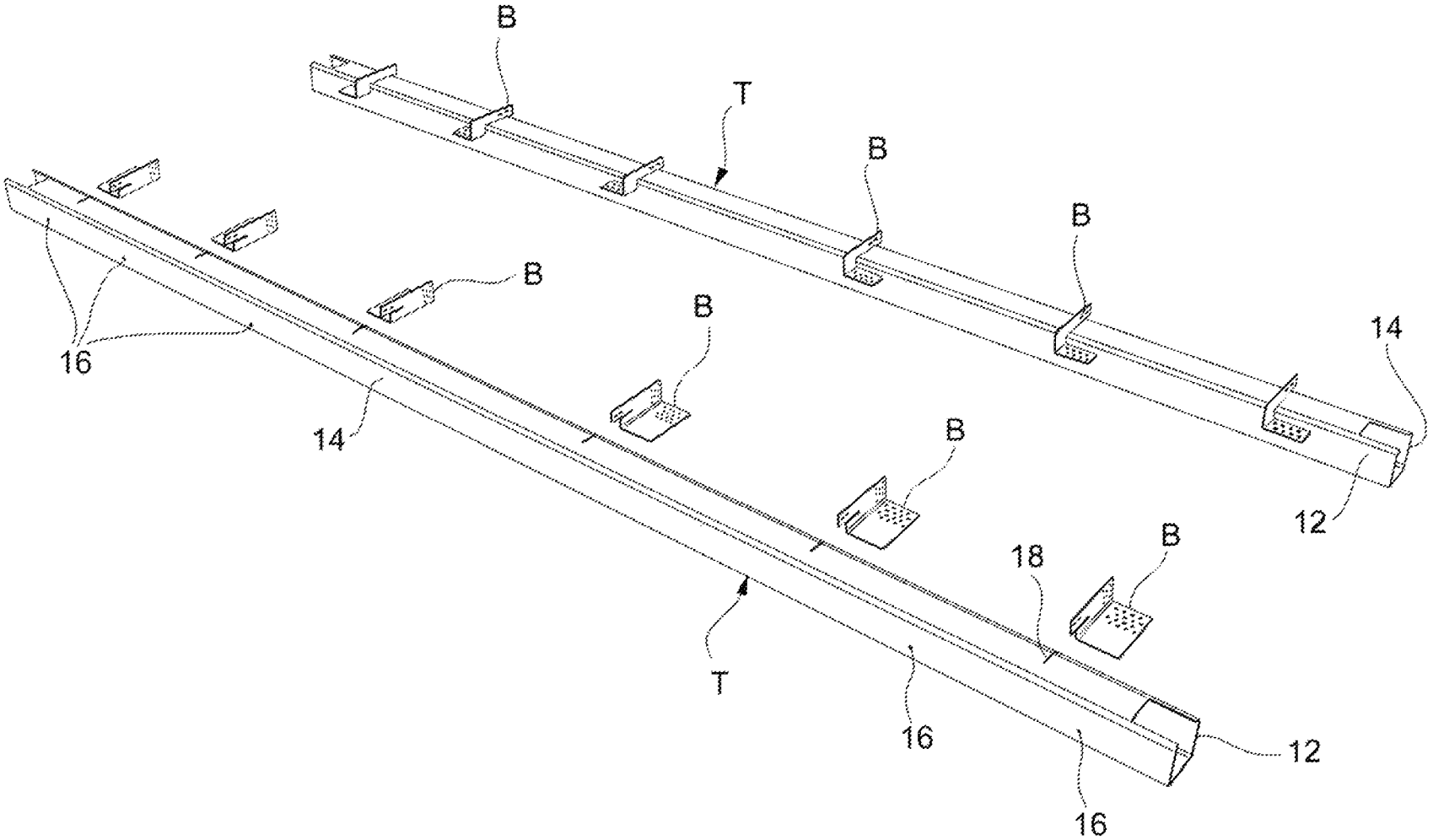
FIG. 4 is a partially-exploded perspective view of the beams and of the connection elements of the building element of FIG. 1, from which the panel has been cancelled for the sake of clarity.

With reference also to FIG. 3, in the proposed embodiment the connection elements B have a substantially L-shaped cross-section or, in broader terms, a cross-section of such a shape as to extend along at least two non-parallel directions, in order to allow for the transmission of loads to the beams T along the two principal directions of the panel P.

Each connection element B comprises a first portion 20 adapted to be connected to the panel P and a second portion 22 adapted to be connected to a beam T. The first portion 20 is inserted into a special seat 18 (in the present case, where the connection element B has an L-shaped cross-section, an L-shaped seat) provided on a respective lateral face L of the panel P and fixed therein by an adhesive, for example by an epoxy resin-based adhesive. The first portion 20 has a plurality of holes 24 to facilitate the adhesive connection with the panel P. The adhesive may thus be percolated inside the seats 18 so as to ensure the permanent fixing of the connection elements B to the panel P. The firmness of the connection between the connection elements B and the panel P is ensured by the presence of the holes 24 in the first portion 20 of the connection element B.

The second portion 22 of each connection element B protrudes outwardly from the respective side L of the panel P. The second portion 22 has a groove 25, a tab 26 and a slotted hole 27 in the tab 26. Each connection element B is mechanically connected to the respective beam T, by interlocking and subsequent welding in the area of the groove 25 of the connection element B (see FIG. 1).

The proximal face 12 of the beam T is thus in contact with the respective lateral face L of the panel P where the seat 18 is provided and into which the first portion 20 of the connection element B is inserted.

Furthermore, by threaded fasteners (not shown) inserted into the slotted holes 27, the second portion 22 of a connection element B is mechanically connectable with the second portion of a connection element fixed to the adjacent beam of an adjacent building element.

The precision required to obtain a firm and resistant connection between the connection elements B and the beams T is made possible by the modern laser cutting techniques, that can reach a cutting precision up to even 0.1 mm. The same connection elements B are also preferably obtained by laser cutting process starting from a suitable metal profile.

In a preferred configuration of the present disclosure, as shown in FIGS. 1 and 2, the building element E comprises a single panel P of rectangular shape, which is made of wooden multi-layer cross-laminated material and is connected to two steel beams T with a hollow rectangular cross-section through a plurality of connection elements B which are made as plate elements having an L-shaped cross-section and are arranged on the lateral faces L of the panel P, wherein the first portions 20 of the connection elements B are connected to the seats 18 of the panel P by epoxy resin and the second portions 22 of the connection elements B are connected to the beams T by interlocking and welding. According to such a configuration, therefore, the beams T are arranged substantially in the same plane as that of the panel P and, accordingly, the building elements E are also arranged substantially in the same plane, once connected with the respective adjacent beams T to one another.

Alternative configurations may however be envisaged, wherein the building element E comprises a greater number of panels P, be they arranged side-by-side on the same plane or arranged on angled planes, or wherein the beams T are connected to the panel P along at least one of the other sides of the panel, even by suitable modifications of the shape of the beams T in plan view and/or by suitable modifications of the shape of the cross-section of the beams T.

The panel P of each building element E may have, in plan view, a shape other than the rectangular one illustrated in the drawings, for example a trapezoidal or parallelogram shape. The panel P may also have one or more openings and/or one or more through or blind holes.

The beams T may have a cross-section other than the one illustrated herein, for example an hexagonal, octagonal or, more generally, a polygonal cross-section.

The present disclosure also relates to a building system comprising a plurality of flat building elements, as shown in FIG. 5. Such a building system is obtained by assembling a plurality of building elements E according the present disclosure side-by-side. For example, the connection between two adjacent building elements E can be obtained by insertion of suitable threaded fasteners (not shown) in the slotted holes 27 of a connection element B of the first building element E so as to connect that connection element B with a respective connection element B of the second building element E, adjacent to the first one.

The advantages obtainable with the use of a building element according to the disclosure for making a modular building system are, for example, the following:

lightness: the system ensures an improved lightness, both in structural and in architectural terms, reaching a high load-bearing capacity to weight ratio. In this respect, also the environmental sustainability is improved, by virtue of the reduced need of material, the design constraints remaining unchanged;

compactness: the side-by-side arrangement of the beams T with respect to the panel P allows to obtain an overall thickness that is smaller than that of the existing solutions, with clear advantages at the design stage (possibility to reduce the thickness allocated to the structure of the slabs, of the walls, of the coverings etc.) and at the construction stage (saving of space dedicated to storage and transport, ease of assembly and handling, ease of removal for replacement and maintenance);

dry-mount assembly: the system is designed to be assembled in situ with simple connection operations using screws and/or nuts, without adding mortar or other glue components, which facilitates and accelerates the assembly procedure;

automation: the system is designed to allow quick manufacturing and marking of the components in the prefabrication stage, and its basic components, that is panels, beams and connection elements, can be manufactured by manufacturing processes using electronically-controlled machine tools;

seismic-resistance: the use of building elements according to the present disclosure to make the horizontal floor structures and the vertical walls of a building provides the entire structure with high resistance and stiffness properties, both under horizontal loads and under vertical loads, thereby significantly limiting the damages that may be caused by seismic events, first of all by virtue of the reduction in the seismic structural mass.

The principle of the disclosure remaining unchanged, embodiments and constructional details may vary widely from those described by way of non-limiting examples, without thereby departing from the scope of the disclosure as described and claimed herein.

The invention claimed is:

1. A flat building element comprising:

a panel of non-metallic material having a pair of flat and parallel faces, namely a top face and a bottom face, and a plurality of lateral faces extending between said flat and parallel faces, at least one beam of metallic material having a pair of opposed faces, namely a proximal face and a distal face, and a plurality of connection elements of metallic material that rigidly connect said at least one beam to the panel, wherein said at least one beam is arranged along a respective lateral face of said plurality of lateral faces of the panel with the proximal face in contact with said respective lateral face of said plurality of lateral faces, and wherein each connection element of said plurality of connection elements is a plate element comprising a first portion, which is inserted into a respective seat provided on said respective lateral face of said plurality of lateral faces of the panel and is fixed therein by an adhesive, and a second portion, which protrudes from said respective lateral face of said plurality of lateral faces.

2. The flat building element of claim 1, wherein said at least one beam comprises a pair of beams arranged along a pair of opposed and parallel faces of said plurality of lateral faces of the panel.

3. The flat building element of claim 1, wherein said adhesive comprises an epoxy resin-based mixture.

4. The flat building element of claim 1, wherein said first portion of each connection element of said plurality of connection elements has a plurality of holes.

5. The flat building element of claim 1, wherein said second portion of each connection element of said plurality of connection elements is connected to the beam by interlocking connection or welding.

6. The flat building element of claim 1, wherein said second portion of each connection element of said plurality of connection elements has at least one hole for connection to a respective connection element of said plurality of connection elements of an adjacent flat building element through threaded fasteners.

7. The flat building element of claim 1, wherein each connection element of said plurality of connection elements has an L-shaped cross-section, and wherein said respective seat is an L-shaped seat.

8. The flat building element of claim 1, wherein said distal face of said at least one beam has a plurality of holes for insertion of threaded fasteners for connection of said at least one beam to a respective beam of an adjacent flat building element.

9. The flat building element of claim 1, wherein the panel is a multi-layer panel and/or a panel of wooden material.

10. The flat building element of claim 1, wherein the lateral faces of the panel extend perpendicular to said flat and parallel faces.

11. A building system comprising a plurality of flat building elements, each flat building element of said plurality of flat building elements comprising:

a panel of non-metallic material having a pair of flat and parallel faces, namely a top face and a bottom face, and a plurality of lateral faces extending between said flat and parallel faces, at least one beam of metallic material having a pair of opposed faces, namely a proximal face and a distal face, and a plurality of connection elements of metallic material that rigidly connect said at least one beam to the panel, wherein said at least one beam is arranged along a respective lateral face of said plurality of lateral faces of the panel with the proximal face in contact with said respective lateral face of said plurality of lateral faces, and wherein each connection element of said plurality of connection elements is a plate element comprising a first portion, which is inserted into a respective seat provided on said respective lateral face of said plurality of lateral faces of the panel and is fixed therein by an adhesive, and a second portion, which protrudes from said respective lateral face of said plurality of lateral faces.

12. The building system of claim 11, wherein each flat building element of said plurality of flat building elements is connected to an adjacent flat building element through threaded fasteners.

* * * * *